US011118329B2

(12) United States Patent
Jura et al.

(10) Patent No.: US 11,118,329 B2
(45) Date of Patent: Sep. 14, 2021

(54) RETAINER SLEEVE

(71) Applicant: Caterpillar Inc., Deerfield, IL (US)

(72) Inventors: Jason Jura, Peoria, IL (US); Corey Wells, Peoria, IL (US); Eric Sinn, Tremont, IL (US); Doug Serrurier, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 297 days.

(21) Appl. No.: 16/430,150

(22) Filed: Jun. 3, 2019

(65) Prior Publication Data

US 2020/0378090 A1 Dec. 3, 2020

(51) Int. Cl.
*E02F 9/28* (2006.01)

(52) U.S. Cl.
CPC ..... *E02F 9/2825* (2013.01); *E02F 9/2833* (2013.01); *E02F 9/2841* (2013.01)

(58) Field of Classification Search
CPC ..... E02F 9/2825; E02F 9/2833; E02F 9/2841
See application file for complete search history.

(56) References Cited

U.S. PATENT DOCUMENTS 5,172,500 A 12/1992 Renski et al.
5,765,301 A 6/1998 Clendenning
8,925,221 B2 * 1/2015 Jeske ..... E02F 9/2891 37/455
9,139,984 B2 * 9/2015 Chenoweth ..... E02F 9/2833
9,309,651 B2 4/2016 Jeske et al.
10,544,568 B2 * 1/2020 Serrurier ..... E02F 9/2833
2004/0103565 A1 6/2004 Robinson et al.
2014/0259807 A1 9/2014 Jeske et al.
2015/0027009 A1 1/2015 Vannitamby et al.
2015/0033595 A1 2/2015 Chenoweth et al.
2017/0328037 A1 11/2017 Serrurier et al.
2020/0131742 A1 * 4/2020 Serrurier ..... B29C 64/393

* cited by examiner

*Primary Examiner* — Gary S Hartmann

(74) *Attorney, Agent, or Firm* — Procopio, Cory, Hargreaves & Savitch LLP

(57) ABSTRACT

A retainer sleeve for use with a lock in a ground engaging tool. The retainer sleeve may include an outer skirt extending around a retainer axis, where the outer skirt may include an outer surface formed to mate with a lock cavity of the ground engaging tool. The retainer sleeve can further include an inner sleeve flexibly connected to the outer skirt via a lower bend. The inner skirt may be formed to rotatably receive an outer surface of the lock. The retainer sleeve may also include a detent projection extending radially inward from the inner skirt with respect to the retainer axis and formed to engage a detent recess of the lock to releasably hold the lock.

20 Claims, 6 Drawing Sheets

RETAINER SLEEVE

TECHNICAL FIELD

The present disclosure generally pertains to ground engaging tools. More particularly this application is directed toward a retainer sleeve.

BACKGROUND

Earth-working machines, such as, for example, excavators, wheel loaders, hydraulic mining shovels, cable shovels, bucket wheels, bulldozers, and draglines, are generally used for digging or ripping into the earth or rock and/or moving loosened work material from one place to another at a worksite. These earth-working machines include various earth-working implements, such as a bucket or a blade, for excavating or moving the work material. These implements can be subjected to extreme wear from the abrasion and impacts experienced during the earth-working applications.

To protect these implements against wear, and thereby prolong the useful life of the implements, various ground engaging tools, such as teeth, edge protectors, and other wear members, can be provided to the earth-working implements in the areas where the most damaging abrasions and impacts occur. These ground engaging tools are removably attached to the implements using customized retainer systems, so that worn or damaged ground engaging tools can be readily removed and replaced with new ground engaging tools.

Many retainer systems have been proposed and used for removably attaching various ground engaging tools to earth-working implements. One example of such retainer system is described in U.S. Pat. No. 9,309,651 to Jeske et al. The disclosed retainer system includes a retainer bushing for use with a lock in a ground engaging tool. The retainer bushing may include a skirt extending around a retainer axis, where the skirt may include an outer surface configured to mate with a lock cavity of the ground engaging tool and an inner surface configured to rotatably receive an outer surface of the lock. The retainer bushing may also include a detent projection extending radially inward from the inner surface with respect to the retainer axis and configured to engage a detent recess of the lock to releasably hold the lock. The detent projection may include a convex surface with a substantially constant radius, and a center of the radius of the convex surface may be positioned at a first distance from the retainer axis that is greater than a second distance between the retainer axis and the outer surface of the skirt.

The present disclosure is directed toward overcoming one or more of the problems discovered by the inventors.

SUMMARY

A retention sleeve for use with a lock in a ground engaging tool is disclosed herein. The retention sleeve includes an outer skirt. The outer skirt circumferentially extending around a retainer axis. The outer skirt includes an upper portion, a middle bend extending outward from the upper portion with respect to the retainer axis, and a lower portion extending inward from the middle bend with respect to the retainer axis, disposed opposite from the upper bend. The retention sleeve additionally includes a lower bend extending inward from a portion of the lower portion with respect to the retainer axis. The retention sleeve further includes an inner skirt extending partially from the lower bend and circumferentially around the retainer axis, disposed radially inward to the outer skirt with respect to retainer axis.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

Figure 1:
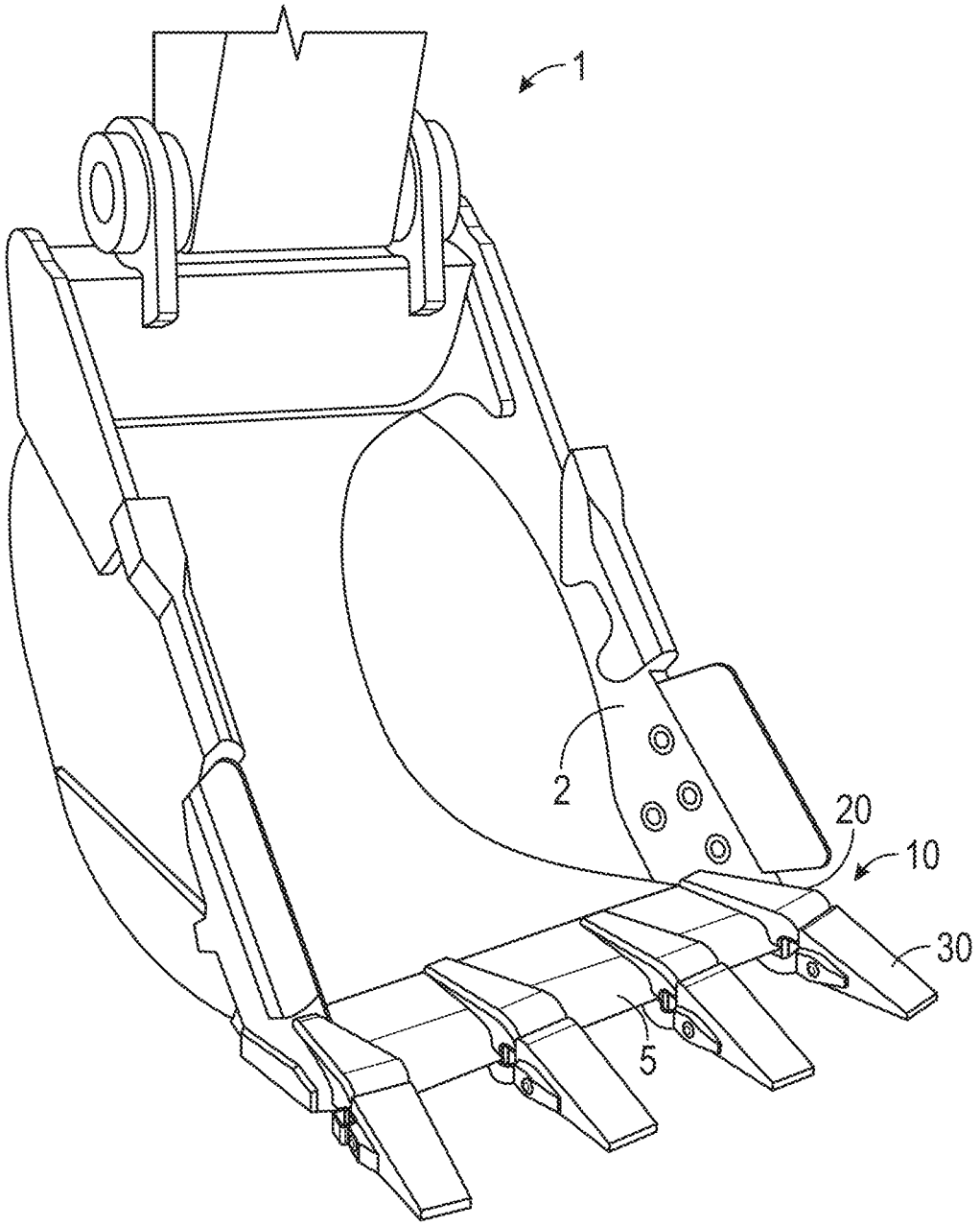
FIG. 1 is a perspective view of a loader bucket having a plurality of ground engaging tools attached thereto according to an exemplary embodiment.

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation FIG. 1 is a perspective view of a loader bucket having a plurality of ground engaging tools attached thereto according to an exemplary embodiment. FIG. 1 illustrates an excavator bucket assembly 1 as an exemplary implement of an earth-working machine. Excavator bucket assembly 1 includes a bucket 2 used for excavating work material in a known manner. Bucket 2 may include a variety of ground engaging tools. For example, bucket 2 may include a plurality of tooth assemblies 10, as ground engaging tools, attached to a base edge 5 of bucket 2. Tooth assemblies 10 may be secured to bucket 2 employing retainer systems according to the present disclosure. While various embodiments of the present disclosure will be described in connection with a particular ground engaging tool (e.g., tooth assembly 10), it should be understood that the present disclosure may be applied to, or used in connection with, any other type of ground engaging tools or components. Further, it should be understood that one or more features described in connection with one embodiment can be implemented in any of the other disclosed embodiments unless otherwise specifically noted.

Figure 2:
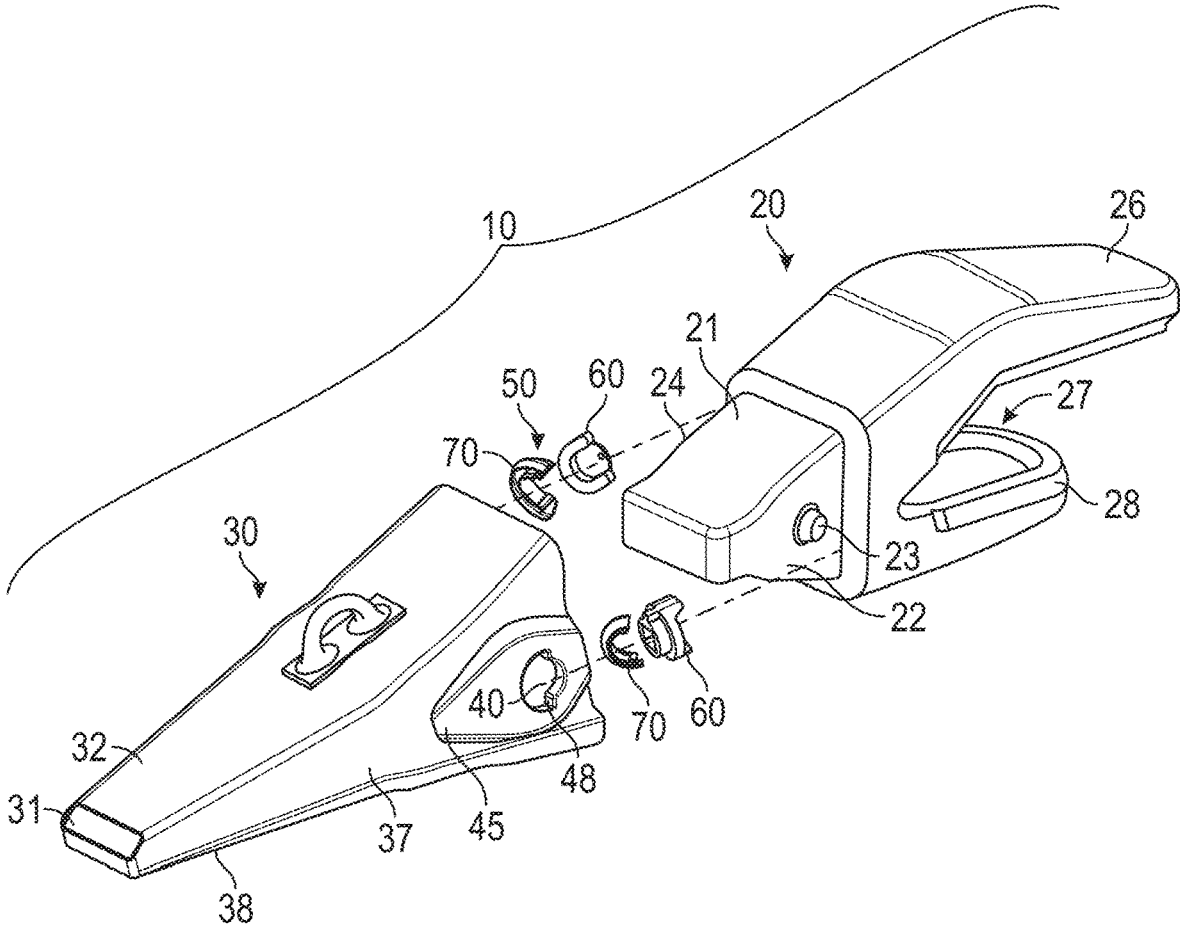
FIG. 2 is an exploded perspective view of a tooth assembly according to an exemplary embodiment.

FIG. 2 is an exploded perspective view of a tooth assembly according to an exemplary embodiment. The tooth assembly 10 may include an adapter 20 configured to engage base edge 5 of bucket 2 or other suitable support structure of an implement. Tooth assembly 10 may also include a ground-engaging tip 30 or tip formed to be removably attached to adapter 20. Tooth assembly 10 may further include a retainer system 50 formed to secure tip 30 to adapter 20. Tip 30 endures the majority of the impact and abrasion caused by engagement with work material, and wears down more quickly and breaks more frequently than adapter 20. Consequently, multiple tips 30 may be attached to adapter 20, worn down, and replaced before adapter 20 itself needs to be replaced. As will be detailed herein, various exemplary embodiments of retainer system 50, consistent with the present disclosure, may facilitate attachment and detachment of ground engaging tools and tips 30 to and from the adapter 20 attached to an implement.

Adapter 20 may include a pair of first and second mounting legs 26, 28 defining a recess 27 there between for receiving base edge 5. Adapter 20 may be secured in place on base edge 5 by attaching first mounting leg 26 and second mounting leg 28 to base edge 5 using any suitable connection method. For example, mounting legs 26 and 28 and base edge 5 may have corresponding apertures (not shown) through which any suitable fasteners such as bolts or rivets may be inserted to hold adapter 20 in place. Alternatively or additionally, mounting legs 26 and 28 may be welded to the corresponding top and bottom surfaces of base edge 5. Any other connection method and/or configuration known in the art may be used alternatively or additionally. For example, in some exemplary embodiments, an adapter 20 may be configured to use any of the retainer systems 50 disclosed herein to secure the adapter 20 to a ground engaging tip 30.

The adapter 20 may include a nose 21 extending in a forward direction. Nose 21 may be configured to be received in a mounting cavity 35 (shown in FIG. 3) of tip 30. Nose 21 may be configured to support tip 30 during use of bucket 2 and to facilitate retention of tip 30 on nose 21 when bearing the load of the work material.

Nose 21 may include an integral post 23 extending from each lateral side 22, 24. Post 23 may have various shapes and sizes. In one exemplary embodiment, as shown in FIG. 2, post 23 may have a frustoconical shape. As will be described in more detail herein, posts 23 may cooperate with retainer system 50 to secure tip 30 to adapter 20.

Figure 3:
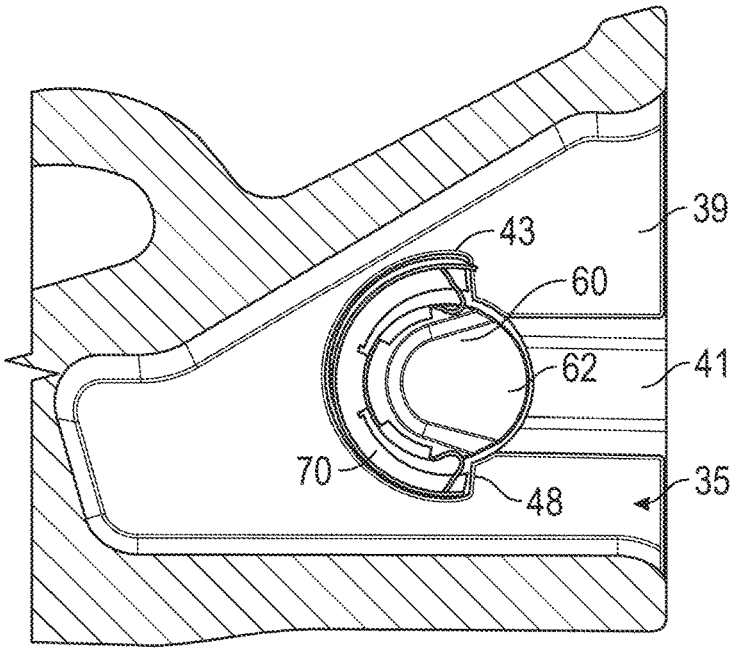
FIG. 3 is a cross section view of a portion of the tip of the tooth assembly shown in FIG. 2, with a lock and a retainer sleeve positioned in a lock cavity of the tip.

FIG. 3 is a cross section view of a portion of the tip of the tooth assembly shown in FIG. 2, with a lock and a retainer sleeve positioned in a lock cavity of the tip. Tip 30 may define mounting cavity 35 inside tip 30 having a complementary configuration relative to nose 21 of adapter 20. Tip 30 may have various outer shapes.

For example, looking back at FIG. 2, tip 30 may generally taper as it extends forward. For example, an upper surface 32 of tip 30 may slope downward as it extends forward, and a lower surface 38 of tip 30 may extend generally upward as it extends forward. Alternatively, lower surface 38 may extend generally straight or downward as it extends forward. At its forward end, tip 30 may have a wedge-shaped edge 31.

Referring to FIG. 2, tip 30 may be secured to adapter 20 via retainer system 50. Retainer system 50 may include a lock 60 and a retainer sleeve 70. Tip 30 and/or adapter 20 may have various configurations for accommodating lock 60 and retainer sleeve 70 therein. For example, in the exemplary embodiment shown in FIGS. 2 and 3, tip 30 may include a lock cavity 40 in each of its lateral sides 37 for housing the lock 60 and retainer sleeve 70. Lock 60 and retainer sleeve 70 may be seated within lock cavity 40 when assembled to tip 30. Tip 30 may also include a lock bulge 45 extending outward of each lock cavity 40. While the exemplary embodiment shown in FIGS. 2 and 3 has lock cavity 40 and lock bulge 45 on each lateral side 37 of tip 30, tip 30 may have different numbers and/or arrangements of lock cavities 40 and lock bulges 45.

Figure 4:
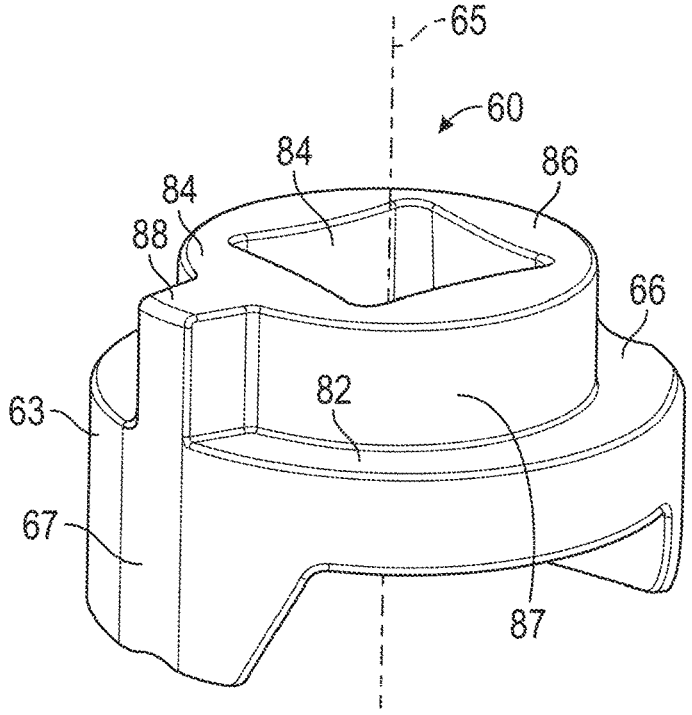
FIG. 4 is a perspective view of the lock of the retainer system from FIG. 2.

FIG. 4 is a perspective view of the lock of the retainer system from FIG. 2. The lock 60 can include a lock skirt 63 with an outer surface 66 that may extend circumferentially around and concentric with lock rotation axis 65. The lock skirt 63 can be substantially cylindrically shaped or conically shaped. The lock skirt 63 can have one or more detent recesses 67 that may extend radially inward from outer surface 66 of lock skirt 63. Detent recesses 67 may include a concave surface, such as a constant-radius curved surface, extending radially inward from outer surface 66.

Lock 60 may also include a head portion 80 attached to lock skirt 63 adjacent an end of lock skirt 63. The head portion 80 may include a wall 82 extending in a plane that can be substantially perpendicular to lock rotation axis 65 and across the end of lock skirt 63 adjacent the head portion 80. The head portion can include a projection 86 extending from wall 82 away from lock skirt 63 along lock rotation axis 65. Projection 86 may include a substantially cylindrical outer surface 87 extending around most of lock rotation axis 65 and a tab 88 extending radially outward relative to lock rotation axis 65.

Lock 60 may also include a tool interface 84 in head portion 80 to facilitate rotating lock 60 about lock rotation axis 65. Tool interface 84 may include any type of features formed to be engaged by a tool for applying torque to lock 60 about lock rotation axis 65. For example, tool interface 84 may include a socket recess with a cross-section formed to engage a socket driver, such as a socket wrench. When lock 60 is seated within lock cavity 40, head portion 80 defining tool interface 84 may extend at least partially through lock cavity 40 and lock bulges 45, and lock cavity 40 may provide an access opening for a tool to engage tool interface 84.

Figure 5:
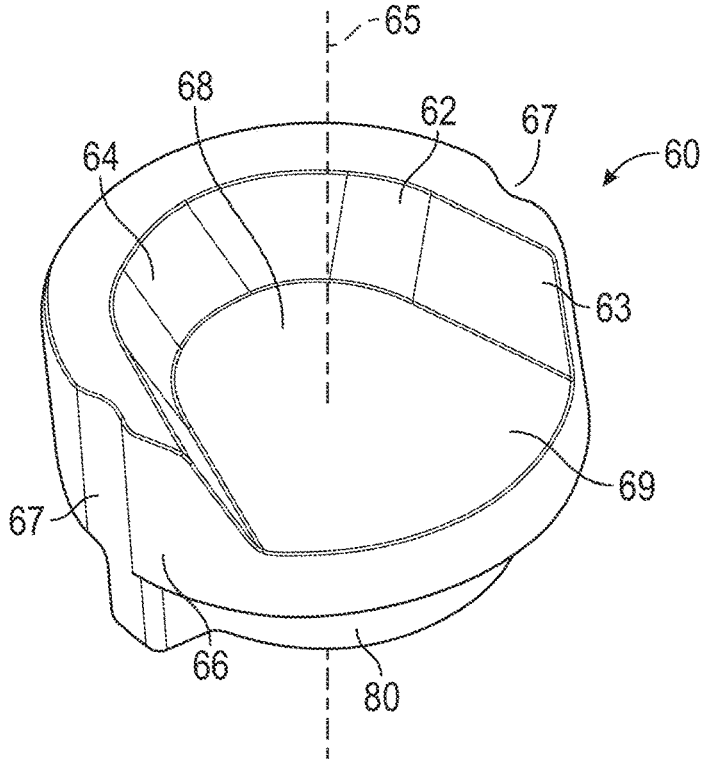
FIG. 5 is a perspective view of the lock shown in FIG. 4 from the opposite side as shown in FIG. 4.

FIG. 5 is a perspective view of the lock shown in FIG. 4. Lock 60 may be formed to receive at least part of post 23 of adapter 20. Lock 60 may include a lock slot 62 extending into lock skirt 63. Lock slot 62 may have an open end 69 between two circumferential ends of lock skirt 63 and a closed end 68 adjacent a middle portion of lock skirt 63. In some embodiments, lock slot 62 may have a size and shape such that it can receive frustoconical post 23 of adapter 20. An inner surface 64 of lock skirt 63 may be sloped so as to mate with frustoconical post 23 of adapter 20 adjacent closed end 68 of lock slot 62.

In some embodiments, wall 82 may fully enclose the side of lock slot 62 adjacent the head portion 80. The side of head portion 80 opposite lock slot 62 may include a projection 86 extending from wall 82 away from lock skirt 63 along lock rotation axis 65. In some exemplary embodiments, tab 88 may extend transverse relative to the direction that lock slot 62 extends from open end 69 to closed end 68.

Referring back to FIG. 3, lock 60 and retainer sleeve 70 may be formed to seat within an inner surface 43 of lock cavity 40 in a manner allowing lock 60 to rotate at least partially around a lock rotation axis 65 (FIGS. 4 and 5) relative to retainer sleeve 70. Retainer sleeve 70 may seat directly against inner surface 43 of lock cavity 40, and lock 60 may seat against inner skirt 74 of retainer sleeve 70. On the rear side of lock cavity 40, lock cavity 40 may open into a side slot 41 that extends rearward from lock cavity 40 along an inner surface 39 of lateral side 37. Side slot 41 may have a cross-section configured to allow passage of at least a portion of post 23 of adapter 20 being inserted from the rear end of tip 30.

Figure 6:
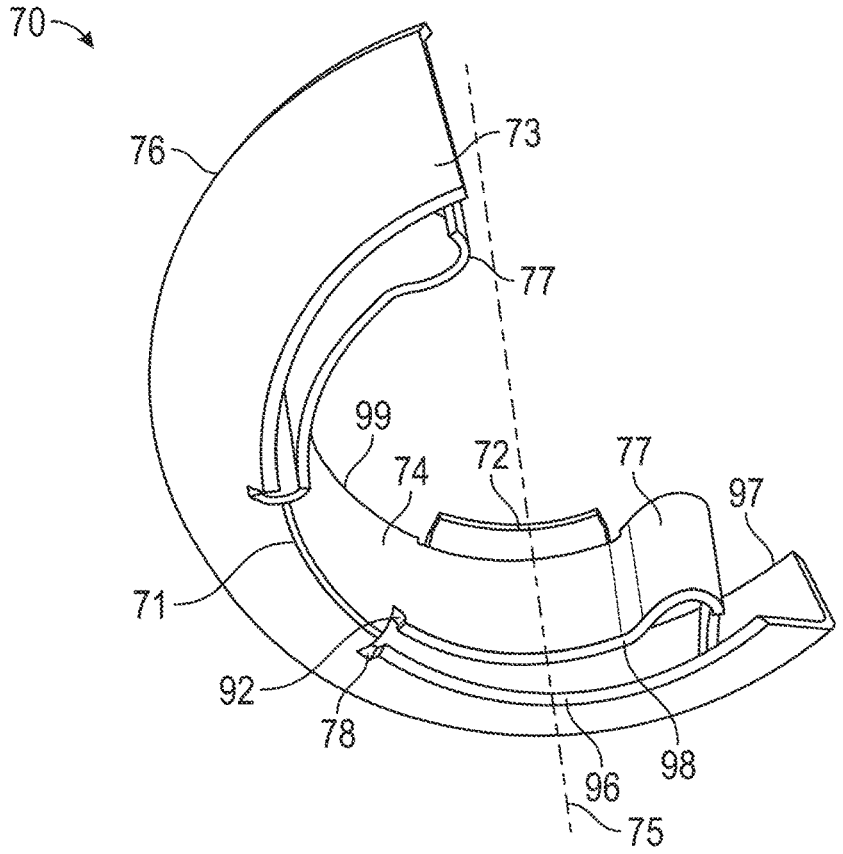
FIG. 6 is a perspective view of the retainer sleeve of the retainer system shown in FIG. 2.
Figure 7:
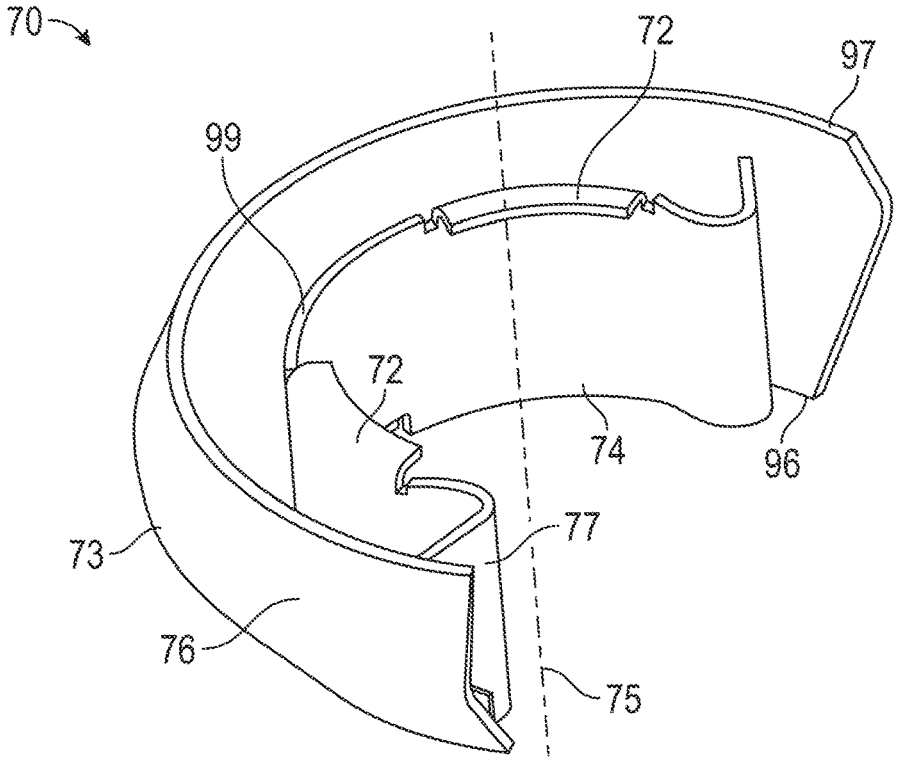
FIG. 7 is a perspective view of the retainer sleeve of FIG. 6 from the opposite side shown in FIG. 6.

Referring to FIGS. 6 and 7, retainer sleeve 70 may include an outer skirt 73 in the form of a continuous "C" shape that extends around a retainer axis 75. Outer skirt 73 may extend only partway around retainer axis 75. In some exemplary embodiments, outer skirt 73 may extend approximately the same angular degree around retainer axis 75 as inner surface 43 of lock cavity 40 extends around lock rotation axis 65. The outer skirt 73 can extend from a top edge 97 to a bottom edge 96. The bottom edge 96 can be disposed opposite from and inward from the top edge 97. The bottom edge 96 and top edge 97 can be flat, such that they are substantially perpendicular to the retainer axis 75 and parallel to each other. The outer skirt 73 can include outer skirt ends 95 disposed at the angular beginning and end of the outer skirt 73 around the retainer axis 75.

The retainer sleeve 70 can have a lower bend 71 extending inward from the bottom edge 96 of the outer skirt 73. The lower bend 71 can be disposed along bottom edge 96, between the outer skirt ends 95. The outer skirt 73 can circumferentially extend from the lower bend 71 partially around the retainer axis 75. In other words the outer skirt 73 can circumferentially cantilever from the lower bend 71 with respect to the retainer axis 75. The arc length of the lower bend 71 can be less than a fourth of the arc length of the outer skirt 73 and can be proportional to the outer skirt 73 perimeter. The lower bend 71 can extend inward and upwards from the bottom edge 96. The lower bend 71 can be formed to position the inner skirt 74. The inner skirt 74 can circumferentially extend from the lower bend 71 with respect to the retainer axis 75. In other words the inner skirt 74 can circumferentially cantilever from the lower bend 71 with respect to the retainer axis 75. The lower bend 71 can bend at a constant radius. Alternatively, the lower bend 71 may have multiple curvatures which can facilitate the positioning of the inner skirt 74. The lower bend 71 can be disposed radially between the outer skirt 73 and inner skirt 74 with respect to the retainer axis 75.

The bottom edge 96 can include outer skirt recesses 78 disposed adjacent to the connection between the lower bend 71 and the outer skirt 73.

The inner skirt 74 can extend between an inner top edge 99 and an inner bottom edge 98. The inner bottom edge 98 can be disposed opposite from the inner top edge 99. The inner bottom edge 98 and inner top edge 99 can be flat, so that they are substantially perpendicular to the retainer axis 75 and parallel to each other. The inner skirt 74 can be flexibly joined to the outer skirt 73 by the lower bend 71. The inner skirt 74 is disposed inward of the outer skirt 73. The inner skirt 74 can extend generally parallel with the retainer axis 75. The inner skirt 74 can cantilever from the lower bend 71 and extend around the retainer axis 75. The inner skirt 74 can extend upwards from the lower bend 71 and may be in the form of a continuous "C" shape that extends around a retainer axis 75. The inner skirt 74 may extend approximately the same angular degree around retainer axis 75 as outer surface 66 of lock 60 extends around lock rotation axis 65. The perimeter of the inner skirt 74 can be longer than the lower bend 71 and shorter than the perimeter of the outer skirt 73. The lower bend 71 can extend inward from a portion of the bottom edge 96 to a portion of the inner bottom edge 98 with respect to the retainer axis 75.

The inner bottom edge 98 can include inner skirt recesses 92 disposed adjacent to the connection between the lower bend 71 and the inner skirt 74.

In some exemplary embodiments, retainer sleeve 70 may include one or more detents for engaging corresponding detents of lock 60. For example, as shown in FIGS. 6 and 7, retainer sleeve 70 may include detent projections 77 extending radially inward from inner skirt 74. Detent projection 77 may form the circumferential ends of the inner skirt 74. Detent projections 77 may be located at various positions on retainer sleeve 70. For example, detent projections 77 may be spaced approximately 180 degrees from one another around retainer axis 75. Detent projections 77 may comprise of two detent projections 77 and may be referred to as a first detent projection and a second detent projection.

Detent projections 77 may have various shapes. In one exemplary embodiment, each detent projection 77 may include a generally convex curved surface, such as a multi-curvature surface, jutting radially inward from inner skirt 74. The convex curved surface of the detent projection 77 may curve back towards the outer skirt 73 and transition to a linear portion extending toward the outer skirt 73. The detent projections 77 can maintain their shape and size along a direction generally parallel to retainer axis 75.

The inner skirt 74 can include one or more flanges (two are shown and are labeled 72) that extend inward from the inner top edge 99 towards the retainer axis 75. The flange 72 can have multiple curvatures. The flange 72 can be disposed proximate to the detent projection 77. The flange can be disposed along the radial extension of the inner skirt 74 between the detent projections 77. Multiple flanges 72 may be located at various positions on inner skirt 74. The flange can be formed to receive the lock skirt 63 of the lock 60.

The inner top edge 99 can include flange recesses 91 disposed adjacent to the connection between the flange 72 and the inner skirt 74.

Figure 8:
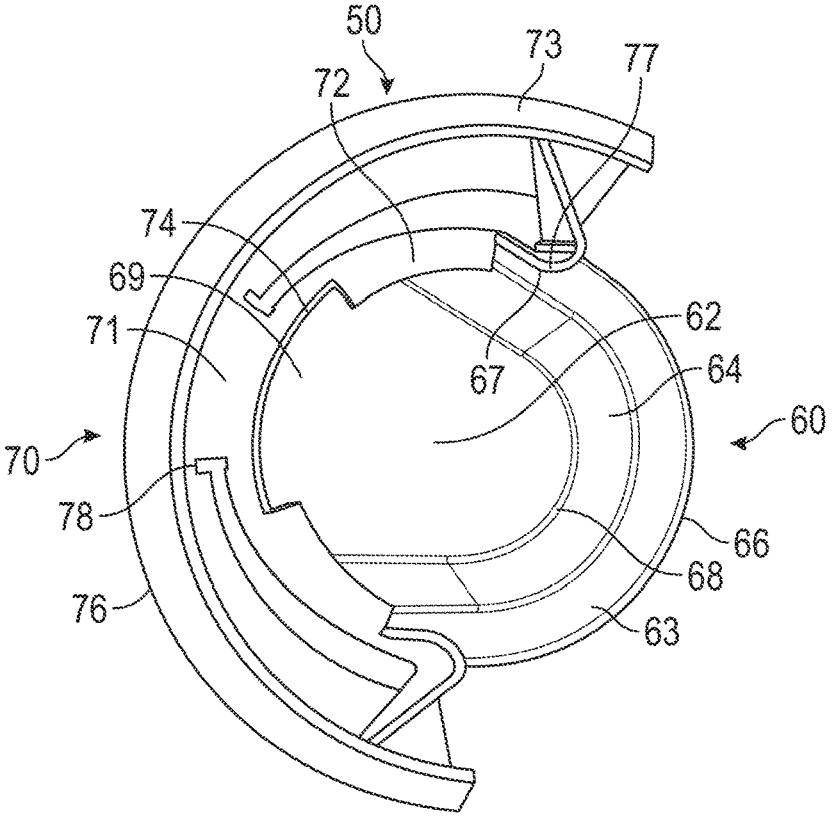
FIG. 8 is a plan view illustrating a cooperative arrangement between the lock of FIGS. 4 and 5 and the retainer sleeve of FIGS. 6 and 7.
Figure 9:
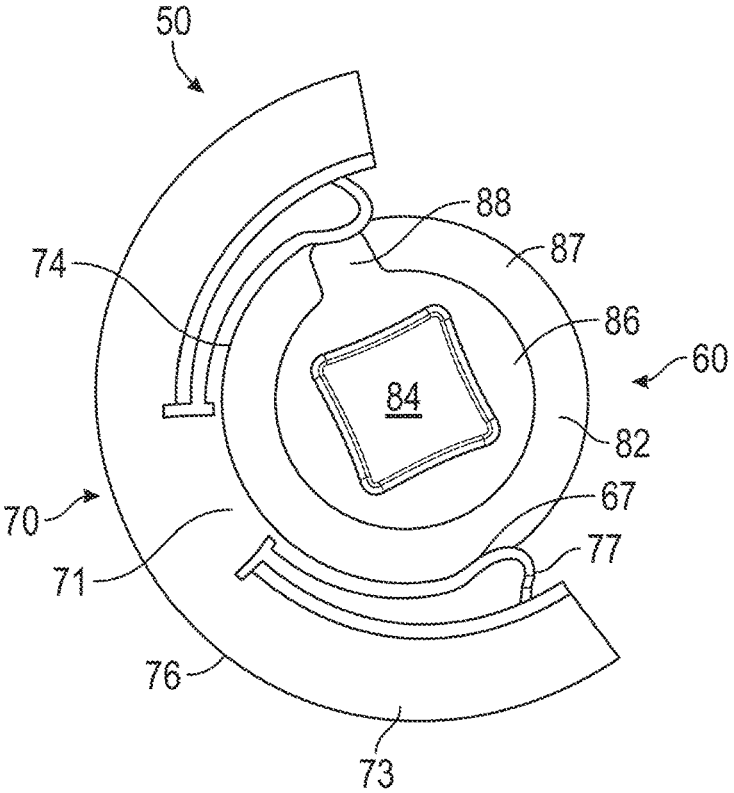
FIG. 9 is a plan view from the opposite side show in FIG. 8 illustrating the cooperative arrangement between the lock and the retainer sleeve of FIG. 8.
Figure 10:
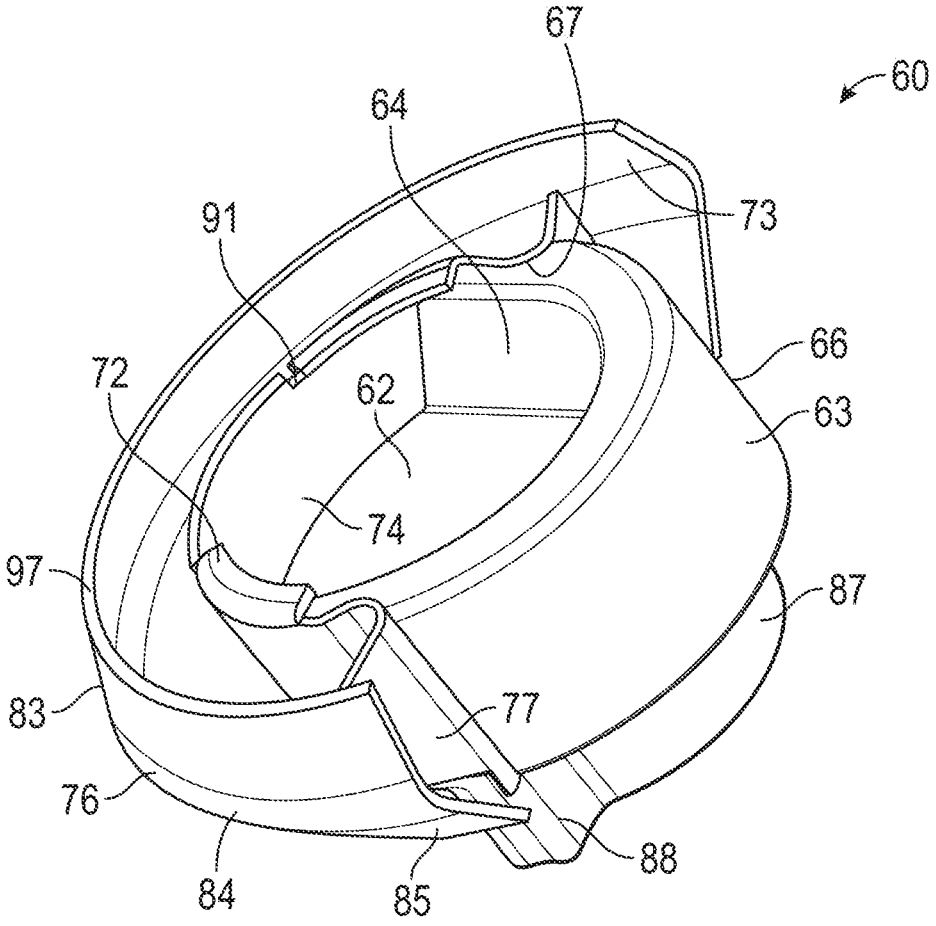
FIG. 10 is a perspective view illustrating the cooperative arrangement between the lock and the retainer sleeve of FIG. 8.

Referring to FIGS. 8-10, retainer sleeve 70 may be formed to mate with inner surface 43 of lock cavity 40. For example, retainer sleeve 70 may include an outer surface 76 having a frustoconical shape formed to mate with a corresponding frustoconical portion of inner surface 43 in lock cavity 40. When retainer sleeve 70 is disposed within lock cavity 40 with outer surface 76 mated to the corresponding frustoconical portion of inner surface 43, retainer axis 75 may coincide with lock rotation axis 65 of lock 60, as shown in FIG. 10. The outer surface 76 can include a portion directly opposite to a portion of the inner skirt 74 from which the detent projection 77 extends comprises a smooth surface without a depression.

Lock cavity 40 may be formed such that, when retainer sleeve 70 is seated in lock cavity 40, rotation of retainer sleeve 70 with respect to lock rotation axis 65 is substantially prevented. For example, as shown in FIG. 2, lock cavity 40 may include a shoulder 48 extending adjacent the circumferential outer ends of inner surface 43 and abutting the circumferential outer ends of outer skirt 73 of retainer sleeve 70. Retainer sleeve 70 may also include an inner skirt 74 opposite outer surface 76 and extending circumferentially around and concentric with retainer axis 75. Accordingly, inner skirt 74 may extend circumferentially around and concentric with lock rotation axis 65 when retainer sleeve 70 is assembled with lock 60 in lock cavity 40.

As mentioned above, lock 60 may be formed to mate with inner skirt 74 of retainer sleeve 70. For example, as shown in FIGS. 4 and 5, lock 60 may include a lock skirt 63 with an outer surface 66 having a substantially the same profile as inner skirt 74 of retainer sleeve 70. Outer surface 66 of lock skirt 63 may be concentric with and extend circumferentially around lock rotation axis 65. Lock skirt 63 and outer surface 66 may extend only partway around lock rotation axis 65. For example, lock skirt 63 and outer surface 66 may extend around lock rotation axis 65 substantially the same angular degree that outer skirt 73 of retainer sleeve 70 extends around retainer axis 75. With lock skirt 63 and outer surface 66 of lock 60 so configured, lock 60 may be seated within retainer sleeve 70 with outer surface 66 of lock 60 mated to inner skirt 74 of retainer sleeve 70. When lock 60 is so positioned within retainer sleeve 70, lock rotation axis 65 may coincide with retainer axis 75.

Referring to FIG. 10, outer skirt 73 can include an upper portion 103, a middle portion 104 and a lower portion 105. The upper portion 103 can extend from the top edge 97 outwards and towards the bottom edge 96 (not shown in FIG. 10) with respect to the retainer axis 75. The middle portion 104 can extend outwards from the upper portion 103 with respect to the retainer axis 75. The middle portion 1044 can curve and transition from extending outwards to extending inwards, like an elbow, with respect to the retainer axis 75. The lower portion 105 can extend inwards from the middle portion 104 to the bottom edge 96 with respect to the retainer axis 75. A portion of the lower portion 105 can be disposed inward of the upper portion 103 with respect to the retainer axis 75. The lower bend 71 can extend from a portion of the lower portion 108 to a portion of the inner bottom edge 98 with respect to the retainer axis 75.

Lock 60 may include one or more detent recesses 67 formed to engage corresponding detent projections 77 of retainer sleeve 70 to releasably hold lock 60 in predetermined rotational positions about lock rotation axis 65. For example, as shown in FIGS. 4 and 5, detent recess 67 of lock 60 may extend radially inward from outer surface 66 of lock skirt 63. Detent recesses 67 may have a shape formed to mate with detent projections 77. In the embodiment shown in FIGS. 4 and 5, detent recesses 67 may include a concave surface, such as a constant-radius curved surface, extending radially inward from outer surface 66. In some embodiments, detent recesses 67 may be spaced approximately the same distance from one another as detent projections 77. Thus, where detent projections 77 are spaced approximately 180 degrees from one another, detent recesses 67 may likewise be spaced approximately 180 degrees from one another. Accordingly, lock 60 may be positioned in retainer sleeve 70 with outer surface 66 seated against inner skirt 74 of retainer sleeve 70 and detent projections 77 extending into detent recesses 67. Retainer sleeve 70 may be formed to deflect so as to allow detent projections 77 to engage and/or disengage detent recesses 67 of lock 60. For example, retainer sleeve 70 may be constructed at least partially of a flexible material, including but not limited to, a plastic material or an elastomeric material. In some embodiments, retainer sleeve 70 may be constructed wholly of such a flexible material.

According to one exemplary embodiment, retainer sleeve 70 may be constructed of self-lubricating material that may either exude or shed lubricating substance. For example, retainer sleeve 70 may be made of thermoplastic material comprising polyoxymethylene (POM), also known as Delrin®. In a further example, the retainer sleeve 70 may be made of metal such as steel. Retainer sleeve 70 made of such material may exhibit low friction while maintaining dimensional stability.

Lock 60 may be constructed of metal. Alternatively or additionally, all or a portion of the surface of lock 60 may be coated with a friction-reducing material. The term "friction-reducing material," as used herein, refers to a material that renders the surface of lock 60 to have a friction coefficient ranging from approximately 0.16 to approximately 0.7. For example, at least a portion of the surface of lock 60 may be plated with zinc to reduce friction on the surface of lock 60 (e.g., surface between lock 60 and retainer sleeve 70) to a friction coefficient between approximately 0.16 to approximately 0.7.

In another exemplary embodiment, at least a portion of the surface of lock 60 may be coated with graphite powder. The graphite powder may be aerosolized and sprayed directly onto the surface of lock 60. Alternatively or additionally, the graphite powder may be mixed with a suitable solvent material and applied to the surface of lock 60 by using a brush or dipping the lock 60 into the mixture. In one exemplary embodiment, a commercially available graphite lubricant, such as the products sold under trademark SLIP Plate, may be used alternatively or additionally.

As mentioned above, lock 60 may be installed with retainer sleeve 70 in lock cavity 40 with outer surface 66 of lock 60 mated to inner skirt 74 of retainer sleeve 70 and detent recesses 67 of lock 60 mated to detent projections 77 of retainer sleeve 70. When lock 60 is disposed in this position, open end 69 of lock slot 62 may face rearward, as shown in FIG. 3. This position allows sliding insertion and removal of post 23 into and out of lock slot 62 through open end 69. Accordingly, this position of lock 60 may be considered an unlocked position.

To lock post 23 inside lock slot 62, lock 60 may be rotated with respect to lock rotation axis 65 to a locked position. In this locked position, the portion of lock skirt 63 adjacent closed end 68 may preclude sliding movement of post 23 relative to lock slot 62, thereby preventing sliding movement of tip 30 relative to adapter 20. The locked position of lock 60 may be approximately 180 degrees from the unlocked position about lock rotation axis 65. In the locked position, as in the unlocked position, detent recesses 67 of lock 60 may engage detent projections 77 of retainer sleeve 70, which may releasably hold lock 60 in the locked position.

To rotate lock 60 between the unlocked position and the locked position, sufficient torque may be applied to lock 60 with respect to lock rotation axis 65 to cause detent projections 77 and/or detent recesses 67 to deflect and disengage from one another. Once detent projections 77 and detent recesses 67 are disengaged from one another, outer surface 66 of lock skirt 63 of lock 60 may slide along inner skirt 74 of retainer sleeve 70 as lock 60 rotates around lock rotation axis 65. Once lock 60 rotates approximately 180 degrees around lock rotation axis 65, detent projections 77 and detent recesses 67 may reengage one another to releasably hold lock 60 in that rotational position.

Lock 60 may also include a tool interface 84 in head portion 80 to facilitate rotating lock 60 about lock rotation axis 65. Tool interface 84 may include any type of features formed to be engaged by a tool for applying torque to lock 60 about lock rotation axis 65. For example, as shown in FIG. 4, tool interface 84 may include a socket recess with a cross-section formed to engage a socket driver, such as a socket wrench. When lock 60 is seated within lock cavity 40, head portion 80 defining tool interface 84 may extend at least partially through lock cavity 40 and lock bulges 45, and lock cavity 40 may provide an access opening for a tool to engage tool interface 84.

Ground engaging tools and the associated retainer systems of the present disclosure are not limited to the exemplary configurations described above. For example, ground engaging tool 10 may include a different number of lock cavities 40, and ground engaging tool 10 may employ a different number and configuration of posts 23, locks 60, and retainer sleeves 70. Additionally, in lieu of adapter 20 and posts 23, ground engaging tool 10 may employ one or more pins fixed to or integrally formed with suitable support structure.

INDUSTRIAL APPLICABILITY

The disclosed retainer systems and ground engaging tools may be applicable to various earth-working machines, such as, for example, excavators, wheel loaders, hydraulic mining shovels, cable shovels, bucket wheels, bulldozers, and draglines. When installed, the disclosed retainer systems and ground engaging tools may protect various implements associated with the earth-working machines against wear in the areas where the most damaging abrasions and impacts occur and, thereby, prolong the useful life of the implements.

The disclosed configurations of various retainer systems and components may provide secure and reliable attachment and detachment of ground engaging tools to various earth-working implements. In particular, certain configurations of the disclosed retainer systems may address certain issues associated with work material getting into the space around the retainer system and increasing friction between components of the retainer system and/or between retainer system and a ground engaging tool. Moreover, certain configurations of the disclosed retainer systems may reduce friction between components of a retainer system and/or between a component of a retainer system and a ground engaging tool.

The disclosed retainer system 50 includes lock 60 and retainer sleeve 70. The outer skirt of the retainer sleeve 70 is formed to mate with inner surface 43 of lock cavity 40 of tip 30, and lock 60 is formed to mate with inner skirt 74 of retainer sleeve 70. To attach tip 30 to adapter 20, lock 60 and retainer sleeve 70 are assembled into lock cavity 40 of tip 30. Lock cavity 40 opens into side slot 41 that extends rearward, which allows passage of post 23 of adapter 20. Once post 23 is inserted inside lock slot 62, lock 60 is rotated about lock rotation axis 65 to a closed position. In this position, the portion of lock skirt 63 adjacent closed end 68 may preclude sliding frustoconical portion of post 23 into or out of lock slot 62, preventing sliding movement of tip 30 relative to adapter 20. In the locked position, detent recesses 67 of lock 60 may engage detent projections 77 of retainer sleeve 70, which may releasably hold lock 60 in the locked position.

To detach tip 30 from adapter 20, lock 60 is rotated from the locked position to an unlocked position to cause detent projections 77 and detent recesses 67 to disengage from one another. Once detent projections 77 and detent recesses 67 are disengaged from one another, outer surface 66 of lock skirt 63 of lock 60 may slide along inner skirt 74 of retainer sleeve 70, as lock 60 rotates around lock rotation axis 65. Once lock 60 rotates approximately 180 degrees around lock rotation axis 65, detent projections 77 and detent recesses 67 may reengage one another to releasably hold lock 60 in that rotational position.

The lower bend 71 is formed to flexibly connect the outer skirt 73 to the inner skirt 74. The lower bend 71 is formed to allow the outer skirt 73 and inner skirt 74 to flex along the lower bend 71 independently of each other, like a hinge point, to accommodate variances in the lock 60 and lock cavity 40 dimensions.

During manufacturing, the lock cavity 40 and the lock 60 can be made slightly larger or smaller in comparison to the design dimensions. In a least material condition (LMC) of the lock cavity 40, the outer skirt 73 can be pre-formed in anticipation for a LMC and can provide a tight fit with the inner surface 43 of the lock cavity 40. In a maximum material condition (MMC) of the lock cavity 40, the outer skirt 73 can flex, independently from the inner skirt 74, towards the inner skirt 74 and the retainer axis 75 to accommodate a tighter fit. The tight fit keeps the lock 60 and the retainer sleeve 70 concentric and in the proper position.

Similarly, in a least material condition (LMC) of the lock 60, the inner skirt 74 can be pre-formed in anticipation for a LMC and can provide a tight fit with the outer surface 66 of the lock skirt 63. In a maximum material condition (MMC) of the lock 60, the inner skirt 74 can flex, independently from the outer skirt 73, toward the outer skirt 73 and away from the retainer axis 75 to accommodate a tighter fit and can prevent the lock 60 from rotating to an unlocked position.

The independent flexibility of the outer skirt 73 and the inner skirt 74 allows the retainer sleeve 70 to accommodate for the LMC and MMC in both the lock cavity 40 and lock 60 as well as lock cavities 40 and locks 60 that are sized to design dimensions.

The outer skirt recess 79 and inner skirt recess 92 can be shaped to provide relief from the lower bend 71 and can release some of the internal stress between the lower bend 71 and the inner skit 74 and outer skirt 73. The flange recess 91 can be shaped to provide relief from the inner skirt 74 and can release some of the internal stress between the flange 72 and inner skirt 74.

The flange 72 can be shaped to hold the retainer 70 from moving along the retainer axis 75 when installed with the lock 60 in the lock cavity 40.

Although this invention has been shown and described with respect to detailed embodiments and examples thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of earth-working machines. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. It is appreciated that features shown or discussed in one embodiment or example can be combined with other features shown or discussed in other embodiments and examples. The embodiments are not limited to those that solve any or all of the stated problems or those that have any or all of the stated benefits and advantages.

What is claimed is:

1. A retainer sleeve for use with a lock in a ground engaging tool, comprising:

an outer skirt extending around a retainer axis and formed to mate with an inner surface of a lock cavity of the ground engaging tool, and having a top edge, and a bottom edge opposite the top edge;

an inner skirt extending around the retainer axis and disposed inward of the outer skirt with respect to the retainer axis, the inner skirt formed to rotatably receive an outer surface of the lock, and having an inner top edge, and an inner bottom edge opposite the top edge; and a lower bend extending inwards from a portion of the bottom edge to a portion of the inner bottom edge, with respect to the retainer axis, coupling the outer skirt to the inner skirt.

2. The retainer sleeve of claim 1, wherein the inner skirt further comprises a detent projection extending radially inward from the inner skirt with respect to the retainer axis and formed to engage a detent recess of the lock to releasably hold the lock.

3. The retainer sleeve of claim 1, wherein the bottom edge is disposed inwards of the top edge with respect to the retainer axis.

4. The retainer sleeve of claim 1, wherein the inner skirt further comprises a flange, disposed opposite from the lower bend and extending inward with respect to the retainer axis.

5. The retainer sleeve of claim 4, wherein the inner skirt further comprises a flange formed to receive a lock skirt of the lock.

6. The retainer sleeve of claim 2, wherein the inner skirt further comprising a second detent projection extending radially from the inner skirt and spaced approximately 180 degrees from the detent projection about the retainer axis.

7. A retainer sleeve for use with a lock in a ground engaging tool, comprising:

an outer skirt circumferentially extending around a retainer axis, and including an upper portion, a middle bend extending outward from the upper portion with respect to the retainer axis, and a lower portion extending inward from the middle bend with respect to the retainer axis, disposed opposite from the upper portion;

a lower bend extending inward from a portion of the lower portion with respect to the retainer axis;

an inner skirt extending partially from the lower bend and circumferentially around the retainer axis, disposed radially inward to the outer skirt with respect to the retainer axis, and having a flange disposed opposite from the lower bend and extending inward with respect to the retainer axis.

8. The retainer sleeve of claim 7, wherein the inner skirt further comprises a detent projection extending radially inward from the inner skirt and formed to engage a detent recess of the lock to releasably hold of the lock.

9. The retainer sleeve of claim 7, wherein the inner skirt extends generally parallel with the retainer axis.

10. The retainer sleeve of claim 8, further comprising a second detent projection extending radially from the inner skirt and spaced approximately 180 degrees from the detent projection about the retainer axis.

11. The retainer sleeve of claim 8, wherein the detent projection comprises a convex surface and extends generally parallel with the retainer axis.

12. The retainer sleeve of claim 7, wherein the lower bend is formed to allow the inner skirt and the outer skirt to flex independently from each other.

13. The retainer sleeve of claim 7, wherein the portion of the lower portion is disposed inward of the upper portion with respect to the retainer axis.

14. The retainer sleeve of claim 10, the detent projections form circumferential ends of the inner skirt.

15. A retainer system for a ground engaging tool, comprising:

a lock including:

a head portion having a tool interface;

a skirt extending from the head portion and including an outer surface; and a detent recess formed on the outer surface of the skirt; and a retainer sleeve including an outer skirt extending around a retainer axis, and having an upper portion, a middle bend extending outward from the upper portion with respect to the retainer axis, and a lower portion extending inward from the middle bend with respect to the retainer axis, disposed opposite from the upper portion, a lower bend extending inward from a portion of the lower portion with respect to the retainer axis, and an inner skirt extending around the retainer axis and disposed inward of the outer skirt with respect to the retainer axis.

16. The retainer system of claim 15, wherein the inner skirt further comprises a detent projection extending radially inward from the inner skirt with respect to the retainer axis and formed to engage the detent recess of the lock to releasably hold the lock.

17. The retainer system of claim 16, wherein the detent projection comprises two detent projections extending radially from the inner skirt about the retainer axis and spaced approximately 180 degrees from one another.

18. The retainer system of claim 17, wherein the detent projections form circumferential ends of the inner skirt.

19. The retainer system of claim 15, wherein the inner skirt further comprises a flange formed to receive a lock skirt of the lock.

20. The retainer system of claim 15, wherein the outer skirt has a "C' shape.

* * * * *